United States Patent [19]

McKey

[11] Patent Number: 4,476,065

[45] Date of Patent: Oct. 9, 1984

[54] INCREASED CAPACITY WET SURFACE AIR COOLING SYSTEM

[75] Inventor: Paul M. McKey, Hamburg, N.Y.

[73] Assignee: Niagara Blower Co., Buffalo, N.Y.

[21] Appl. No.: 486,989

[22] Filed: Apr. 20, 1983

[51] Int. Cl.³ ..... B01F 3/04

[52] U.S. Cl. ..... 261/23 R; 62/305; 165/DIG. 1; 261/130; 261/146; 261/151; 261/153; 261/DIG. 3; 261/DIG. 11

[58] Field of Search ..... 261/22, 23 R, 129, 130, 261/146, 147, 151, 153, DIG. 11, DIG. 77, DIG. 3; 62/305; 165/60, 122, DIG. 1

[56] References Cited

U.S. PATENT DOCUMENTS

| | | | |
|---|---|---|---|
| 247,253 | 9/1881 | Jennings | 261/147 X |
| 1,083,885 | 1/1914 | Lloyd | 261/151 X |
| 1,986,529 | 1/1935 | Ray | 261/151 X |
| 2,732,192 | 1/1956 | Johnson et al. | 261/23 R |
| 3,148,516 | 9/1964 | Kals | 62/305 |
| 3,411,758 | 11/1968 | Edmondson | 261/DIG. 11 |
| 3,831,667 | 8/1974 | Kilgore et al. | 165/122 X |
| 3,865,911 | 2/1975 | Lefevre | 261/DIG. 11 |
| 3,923,935 | 12/1975 | Cates | 261/DIG. 11 |
| 4,301,097 | 11/1981 | Curtis | 261/23 R X |

FOREIGN PATENT DOCUMENTS

| | | | |
|---|---|---|---|
| 3017488 | 12/1980 | Fed. Rep. of Germany | 261/23 R |

*Primary Examiner*—Richard L. Chiesa

*Attorney, Agent, or Firm*—Niro, Jager & Scavone

[57] ABSTRACT

A wet surface air cooling system is disclosed and includes a primary cooling unit having a bundle of heat exchanger tubes. Water is directed over the bundle of heat exchanger tubes and is collected in a collection basin. A secondary cooling tower is provided and a closed circulatory loop draws a portion of the water from the collection basin and directs the water to the secondary cooling tower to increase the cooling capacity of the system. The secondary cooling tower is rendered operative automatically upon sensing a particular temperature of the water in the circulation system of the primary cooling unit.

14 Claims, 1 Drawing Figure

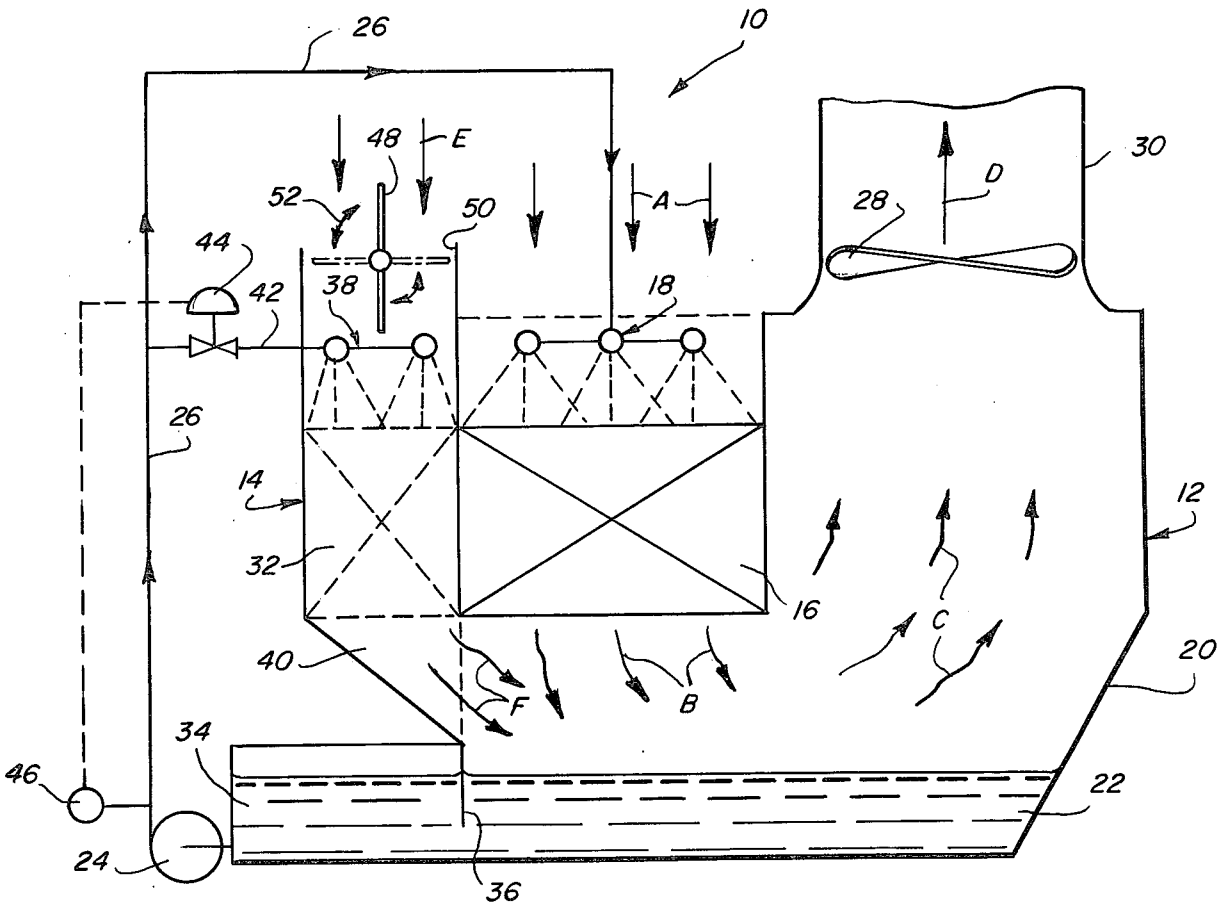
10
12
14
16
18
20
22
24
26
28
30
32
34
36
38
40
42
44
46
48
50
52
A
B
C
D
E
F

INCREASED CAPACITY WET SURFACE AIR COOLING SYSTEM

BACKGROUND AND SUMMARY OF THE INVENTION

This invention relates to a wet surface air cooling system of the evaporative type in which the cooling effect is obtained primarily from the evaporation of water directed onto the exterior of a bundle of exchanger tubes arranged in an airstream passing over the tubes. More particularly, the invention relates to a system of increasing the capacity of a wet surface air cooling unit of the character described.

Air cooling systems of the character described are designed to achieve the required process fluid cooling and/or condensing when a preselected maximum summer design ambient air wet bulb temperature exists. At any temperature lower than the preselected maximum ambient wet bulb temperature, the systems are capable of achieving a higher than designed process fluid cooling or condensing rate. However, the design wet bulb temperature is achieved only from about 1 to 5 percent of summer hours. Consequently, most cooling systems are over-designed to accommodate a relative small percent of their usage time. This, of course, increases the cost of a unit which is operating under capacity the majority of its operating hours.

This invention is directed to a system which employs a secondary cooling unit which is considerably less expensive than conventional exchanger tube units to accommodate those relatively few conditions where full load capacity is required. More particularly, in cooling units which employ a bundle of heat exchanger tubes, a collection basin or sump collects water directed over the exchanger tubes. When a wet surface cooling system is running at full design condition, i.e. at full capacity, the water in the collection basin or sump will reach a particular temperature. When the collected water has reached the maximum temperature and is recycled and sprayed over the heat exchanger, the cooling unit becomes inefficient. This invention contemplates sensing a particular temperature of the water collected in the collection basin, or by other sensing systems, and providing means for decreasing the spray water temperature to increase the capacity of the cooling unit. This is accomplished by employing a secondary cooling unit, such as a cooling tower, refrigeration, or other cooling means, and employing circulation means for drawing a portion of the water from the collection basin, cooling the water through the secondary cooling tower, returning the cooled water back to the collection basin and thereby decreasing the temperature of the water in the basin which is directed over the bundle of heat exchanger tubes. The secondary cooling unit or tower, therefore, only needs to be operative when the unit is subjected to full cooling load and with high ambient wet bulb temperature.

In the exemplary embodiment of the invention, a wet surface air cooling system is provided and comprises a primary cooling unit which includes heat exchanger means, means for directing water over the heat exchanger means, and a collection basin for collecting the water directed over the heat exchanger means. A secondary cooling unit includes a cooling tower and circulation means for selectively drawing a portion of the water from the collection basin and directing the water to the cooling tower to increase the cooling capacity of the system. Return means is provided for returning the portion of the water back to the collection basin.

As disclosed herein, the circulation means, the cooling means whether by a cooling tower or other cooling means, and the return means retain the advantages of having closed loop process fluid cooling whereby the heat exchanger tube bundle contents are closed to the introduction of contaminants. The circulation means includes pump means and selectively operable valve means. The heat exchanger means includes a bundle of heat exchanger tubes and the means for directing water over the heat exchanger means comprises a spray head.

The advantages of the increased capacity wet surface air cooling system of the invention are considerable. The original design size or capacity of conventional wet surface units, such as those employing expensive heat exchanger tubes, is drastically reduced. The secondary cooling unit can be used to retroactively increase the capacity of an existing wet surface unit without simply adding more, expensive heat exchanger tube bundles. The secondary cooling unit can be located at a distance from the primary wet surface cooling unit. Thus, the secondary cooling unit can be incorporated as part of the design of a cooling system to have a predetermined capacity or retroactively, as described. The system is particularly applicable for industrial applications, such as air conditioning installations.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying FIGURE which is a somewhat schematic illustration of a wet surface air cooling system incorporating the invention.

DETAILED DESCRIPTION OF THE INVENTION

Referring to the FIGURE in greater detail, a wet surface air cooling system is illustrated and generally designated 10. The system includes a primary cooling unit, generally designated 12, and a secondary cooling unit, generally designated 14. The primary cooling unit 12 includes heat exchanger means 16, such as a bundle of heat exchanger tubes, and a spray head, generally designated 18, for directing water downwardly onto the bundle of heat exchanger tubes. A shell 20 defines a collection basin 22 for collecting water directed over the heat exchanger tubes. A pump 24 draws water from collection basin 22 and recirculates the water through a line 26 to spray head 18. A fan 28, disposed within a flue 30, discharges air from the interior of shell 20 and causes an airstream from atmosphere past the heat exchanger tubes. The airstream is indicated by arrows A-D. The flue can comprise a prismatic stack, as is known.

At this point it should be noted that primary cooling unit 12 is somewhat conventional and its capacity is generally determined by the size of the bundle of heat exchanger tubes and the volume of air which is passed over the tubes for evaporation purposes. These units are relatively expensive, and increasing the capacity of such a unit requires more heat transfer surface and correspondingly increasingly expensive equipment, such as larger or more fans, larger motors, gears, etc. to force a higher volume of air through the unit. Conventionally, such units are designed for a predetermined full cooling load, such as maximum summer wet bulb temperatures. However, such maximum load requirements occur only approximately 1 to 5 percent of normal summer hours. Therefore, such units as described above are relatively inefficient if they are designed to accomodate maximum cooling loads for a given locality. In essence, increasing the capacity of such units normally requires more heat exchanger surface in addition to more air moving equipment, along with increased energy consumption.

The invention contemplates employing secondary cooling unit 14 which includes a relatively inexpensive cooling tower, refrigeration or other cooling means. The secondary cooling unit may be integral with the wet surface cooling unit or may be separate. The secondary unit includes circulation means for selectively drawing a portion of the water from collection basin 22 and directing the water to cooling tower 32 to increase the cooling capacity of the system, and returning the withdrawn portion of the water back to collection basin 22.

More particularly, collection basin 22 is extended, as at 34, with a weir 36 therebetween. A smaller, secondary spraying head, generally designated 38, is provided for spraying water over the packing in cooling tower 32. A return conduit 40 returns the withdrawn portion of the water back to collection basin 22. The water actually is drawn from the main line 26, which leads from pump 24, through a secondary line 42 to spray head 38. A water valve 44 is disposed in secondary line 42. A temperature switch 46 is coupled between main line 26 and valve 44. The temperature switch senses the water temperature in main line 26 and opens valve 44 when the temperature reaches a predetermined maximum. As stated above, the predetermined maximum condition most desirably would be set when primary cooling unit 12 reaches its maximum capacity. Below that temperature, valve 44 would be closed. A shutter or damper 48 is disposed within a stack 50 above spray head 38 and cooling tower 32. The damper is opened and closed in the direction of double-headed arrow 52. The damper is shown in the FIGURE in opened condition to permit air to be drawn through cooling tower 32 in the direction of arrows E. Like water valve 44, damper 48 can be coupled to and made operative by temperature switch 46. Air is circulated through secondary cooling tower 32 in the direction of arrows F by primary fan 28. Thus, it can be seen that no additional, expensive fans, motors, gears, etc. are required when secondary cooling unit 14 is operative.

It is contemplated that control of the secondary cooling unit can be governed by sensing any one or a combination of the outlet temperature of the process fluid, the spray water temperature, or ambient wet bulb temperature. In the case of condensing units, the pressure of the process fluid can be sensed. In the case of units cooling the contents of a sump, the sump temperature can be sensed.

It is readily apparent that secondary cooling unit 14 is selectively and automatically operable to increase the cooling capacity of wet surface air cooling system 10 without requiring additional, expensive means, such as additional or larger fans, motors, gears, etc. The secondary unit, in the exemplary embodiment of the invention, is rendered operable by a simple temperature switch and water valve coupled together to sense the water temperature in main water line 26 and, thus, the collected water in basin 22 which cascades over the heat exchanger tubes in primary cooling unit 12. Another advantage is that the circulation means, including secondary water line 42, cooling tower 32 and return conduit 40 comprise a closed circulatory loop to prevent entry of contaminants into the system. It is contemplated that secondary cooling unit 14 can be readily designed for retroactive installation on an existing primary cooling unit to increase the cooling capacity of an existing wet surface air cooling system. However, a principal advantage of the concepts of the present invention is that the initial design of a wet surface unit can be smaller in capacity than heretofore required.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A wet surface air cooling system, comprising:

a primary wet surface cooling unit which includes heat exchanger means, a collection basin for collecting water directed over the heat exchanger means, and circulation means for selectively drawing a portion of the water from said collection basin and directing the water over the heat exchanger means;

a secondary cooling unit including cooling means, means for selectively diverting a portion of the water from said circulation means and directing the water to the cooling means for simultaneous cooling of the water to increase the cooling capacity of the system, and return means for returning said portion of the water back to the collection basin; and fan means for circulating air through said primary cooling unit, said secondary unit including means for selectively effecting air circulation therethrough by said fan means of the primary cooling unit.

2. The wet surface air cooling system of claim 1 wherein said circulation means, said cooling means and said return means comprise a closed circulatory loop to prevent entry of any contaminants into the system.

3. The wet surface air cooling system of claim 1 wherein said circulation means includes pump means and selectively operable valve means.

4. The wet surface air cooling system of claim 1 wherein said heat exchanger means includes a bundle of heat exchanger tubes and said means for directing water over the heat exchanger means comprises a spray head.

5. The wet surface air cooling system of claim 1, including means for sensing the temperature of water from said collection basin and automatically actuating said circulation means of the secondary cooling unit in response to the temperature reaching a predetermined level.

6. The wet surface air cooling system of claim 5 wherein said sensing means comprises a temperature switch and said circulation means includes a water valve coupled to and operable by said temperature switch.

7. The wet surface air cooling system of claim 1, including means for sensing a temperature condition of said primary wet surface cooling unit and automatically actuating said circulation means of the secondary cooling unit in response to the sensed condition.

8. A wet surface air cooling system, comprising:

a primary wet surface cooling unit which includes a bundle of heat exchanger tubes, a collection basin for collecting said water directed over the tubes, and circulation means for selectively drawing a portion of the water from said collection basin and directing the water over the heat exchanger tubes;

a secondary cooling tower, means including selectively operable means for diverting a portion of the water from said circulation means and directing the water to the secondary cooling tower for simultaneous cooling of the water to increase the cooling capacity of the system; and fan means for circulating air through said primary cooling unit, said secondary cooling tower including means for selectively effecting air circulation therethrough by said fan means of the primary cooling unit.

9. The wet surface air cooling system of claim 8 including return means for returning said portion of the water back to the collection basin.

10. The wet surface air cooling system of claim 9 wherein said circulation means, said cooling tower and said return means comprise a closed circulatory loop to prevent entry of any contaminants into the system.

11. The wet surface air cooling system of claim 10 wherein said selectively operable means includes pump means and selectively operable valve means.

12. The wet surface air cooling system of claim 8 including means for sensing the temperature of water from said collection basin and automatically actuating said circulation means of the secondary cooling unit in response to the temperature reaching a predetermined level.

13. The wet surface air cooling system of claim 12 wherein said sensing means comprises a temperature switch and said selectively operable means includes a water valve coupled to and operable by said temperature switch.

14. The wet surface air cooling system of claim 8 including means for sensing a temperature condition of said primary wet surface cooling unit and automatically actuating said circulation means of the secondary cooling unit in response to the sensed condition.

* * * * *